US006679531B2

(12) United States Patent
Rogers, Jr. et al.

(10) Patent No.: US 6,679,531 B2
(45) Date of Patent: Jan. 20, 2004

(54) VEHICLE COMPARTMENT LATCH

(75) Inventors: Lloyd Walker Rogers, Jr., Shelby Township, MI (US); Michael Antonio Ciavaglia, Dearborn, MI (US); Michael Todd Moury, Shelby Township, MI (US); Mark Duane Nicholas, Waterford, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/848,037

(22) Filed: May 3, 2001

(65) Prior Publication Data

US 2002/0163207 A1 Nov. 7, 2002

(51) Int. Cl.[7] ..... E05C 3/16

(52) U.S. Cl. ..... 292/216; 292/DIG. 23; 292/DIG. 43

(58) Field of Search ..... 292/201, 216, 292/DIG. 23, DIG. 42, DIG. 43

(56) References Cited

U.S. PATENT DOCUMENTS

| | | | | | |
|---|---|---|---|---|---|
| 3,695,662 | A | | 10/1972 | Ploughman | |
| 3,905,624 | A | * | 9/1975 | Fujita | 292/11 |
| 4,203,621 | A | * | 5/1980 | Noel et al. | 292/216 |
| 4,364,249 | A | * | 12/1982 | Kleefeldt | 292/144 |
| 4,783,102 | A | * | 11/1988 | Bernard | 292/216 |
| 4,875,724 | A | * | 10/1989 | Gruber | 292/216 |
| 4,896,907 | A | * | 1/1990 | Hayakawa et al. | 292/216 |
| 5,071,178 | A | * | 12/1991 | Brackman et al. | 292/216 |
| 5,150,933 | A | * | 9/1992 | Myslicki et al. | 292/216 |
| 5,802,894 | A | * | 9/1998 | Jahrsetz et al. | 292/144 |
| 5,868,444 | A | * | 2/1999 | Brackmann et al. | 292/196 |
| 5,961,163 | A | * | 10/1999 | Brackmann et al. | 292/201 |
| 5,979,951 | A | * | 11/1999 | Shimura | 292/216 |
| 5,997,055 | A | * | 12/1999 | Strathmann | 292/199 |
| 6,048,002 | A | * | 4/2000 | Ohta et al. | 292/201 |
| 6,053,542 | A | * | 4/2000 | Ostrowski et al. | 292/201 |
| 6,109,671 | A | * | 8/2000 | Roncin et al. | 292/216 |
| 6,126,212 | A | * | 10/2000 | Fujihara | 292/216 |
| 6,267,420 | B1 | * | 7/2001 | Miyagawa | 292/216 |
| 6,286,878 | B1 | * | 9/2001 | Hochart et al. | 292/216 |
| 6,378,920 | B1 | * | 4/2002 | Ostrowski et al. | 292/216 |
| 6,390,517 | B1 | * | 5/2002 | Ehret | 292/201 |
| 6,422,615 | B1 | * | 7/2002 | Roos et al. | 292/216 |

FOREIGN PATENT DOCUMENTS

DE 29714953 11/1997

OTHER PUBLICATIONS

Copy of EP Search Report Feb. 24, 2003.

* cited by examiner

*Primary Examiner*—J. J. Swann
*Assistant Examiner*—Thomas Ho
(74) *Attorney, Agent, or Firm*—Scott A. McBain

(57) ABSTRACT

A vehicle compartment latch has a support that is fastened to a deck lid. A fork bolt is pivotally attached to the support and moved from an unlatched position to a latched position by a striker when the deck lid is closed. The fork bolt is held in the latched position by a moveable detent lever that is moved to a release position to release the fork bolt so that the deck lid can be opened. The closure latch includes a detent lock-out that holds the detent lever in the release position until the deck lid is opened once the fork bolt is released. The detent lock out includes a striker position lever that is moved to an engaged position by the striker being retained by the fork bolt and a detent pawl that holds the detent lever in the released position once the detent lever is released.

7 Claims, 3 Drawing Sheets

VEHICLE COMPARTMENT LATCH

TECHNICAL FIELD

This invention relates to a vehicle compartment latch and more particularly to a vehicle compartment latch for latching a vehicle compartment closure, such as a trunk deck lid in the closed position to secure the vehicle compartment.

BACKGROUND OF THE INVENTION

Passenger vehicles are normally equipped with a rear vehicle compartment for storing a spare tire and transporting items such as groceries and luggage. The compartment, conventionally known as a trunk is closed by a deck lid that is hinged to the vehicle body and swings open to provide access to the compartment. The closure or deck lid is equipped with a compartment latch that cooperates with a striker attached to the vehicle body to latch the closure in the closed position automatically when the deck lid is closed.

A conventional compartment latch comprises a pivotally mounted fork bolt and a cooperating spring biased detent lever. The fork bolt is spring biased to an open or unlatched position where a slot of the fork bolt is poised to receive the striker that is attached to the vehicle body. The detent lever moves between a latched position and a release position and is spring biased toward the latched position. When the deck lid is closed, the striker enters the slot of the fork bolt and pivots or rotates the fork bolt to the latched position. As the fork bolt rotates to the latched position, the fork bolt cams the spring biased detent lever out of the way and then back to the latched position where a catch of the detent lever engages a latch shoulder of the fork bolt and holds the fork bolt in the latched position.

In order to open the deck lid, the detent is moved to the release position releasing the latch shoulder of the fork bolt and allowing the fork bolt to pivot to the open position to release the striker so that the deck lid can be opened. When the fork bolt is released, the seal force, that is, the force of the rubber seal around the deck lid that is compressed when the deck lid is closed, tends to open the deck lid a little and move the striker out of the slot so that the fork bolt rotates to the unlatched position. However, the weight of the deck lid tends to keep the deck lid closed and the striker engaged with the fork bolt so that the fork bolt does not pivot to the unlatched position. Thus the weight of the deck lid vis-a-vis the seal force raises the possibility of the spring biased detent moving back to the latched position and holding the fork bolt in the latched position before the deck lid can be opened manually.

The seal force, that is, the force of the seal around the periphery of the deck lid that is compressed when the deck lid is closed, can be increased to insure that the fork bolt, once released, remains released until the deck lid is opened manually. However, the increased seal force also increases the effort required to close and latch the deck lid in the closed position. Thus this solution is not entirely satisfactory, particularly in the case of heavier deck lids. It is also possible to use a kick-off spring or springs to open the deck lid a little bit when the fork bolt is released. However, this solution also increases the closing effort, adds cost, and increases complexity and space requirements.

SUMMARY OF THE INVENTION

This invention provides a vehicle compartment latch insures that the fork bolt, once released, remains released until the deck lid is opened without any need for high seal forces or kick-off springs.

The vehicle compartment latch of the invention has a support that is fastened to a deck lid. A fork bolt is pivotally attached to the support and moved from an unlatched position to a latched position by a striker when the deck lid is closed. The fork bolt is held in the latched position by a moveable detent lever that is moved to a release position to release the fork bolt so that the deck lid can be opened. The closure latch includes a detent lock-out that holds the detent lever in the release position until the deck lid is opened once the fork bolt is released. The detent lock out includes a striker position lever that is moved to an engaged position by the striker being retained by the fork bolt and a detent pawl that holds the detent lever in the released position once the detent lever is released.

These and other objects, features and advantages of the invention will become more apparent from the following description of a preferred embodiment taken in conjunction with the accompanying drawing.

BRIEF DESCRIPTION OF THE DRAWINGS

The presently preferred embodiment of the invention is disclosed in the following description and in the accompanying drawings, wherein.

DETAILED DESCRIPTION OF THE PREFERRED EMBODIMENT

Figure 1:
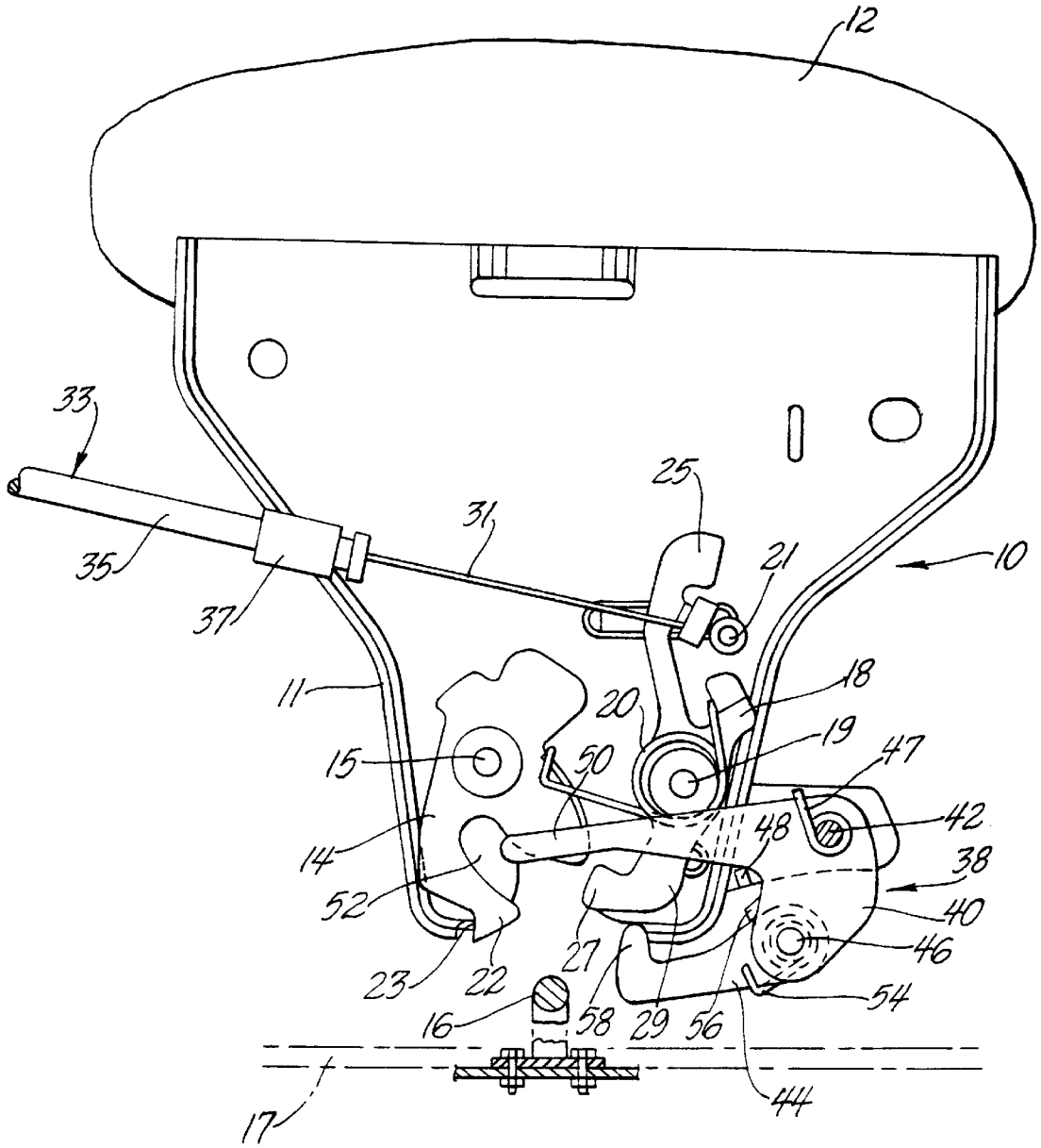
FIG. 1 is a rear view of a vehicle compartment showing the parts of the vehicle compartment latch of the invention when the fork bolt is in the open or unlatched position.

Referring now to FIG. 1 of the drawing, vehicle compartment latch 10 comprises a housing or support 11 that is adapted for fastening to a vehicle compartment closure, such as a trunk compartment deck lid 12. A fork bolt 14 pivots on support 11 about pivot pin 15 between an open or unlatched position shown in FIG. 1 and a closed or latched position shown in FIG. 2. Vehicle compartment latch 10 is attached to deck lid 12 so that fork bolt 14 is moved from the open position shown in FIG. 1 to the closed position shown in FIG. 2 by a striker 16 that is attached to the vehicle body 17, when deck lid 12 is closed. The cooperation of a fork bolt and striker is well known and need not be described in detail.

Figure 2:
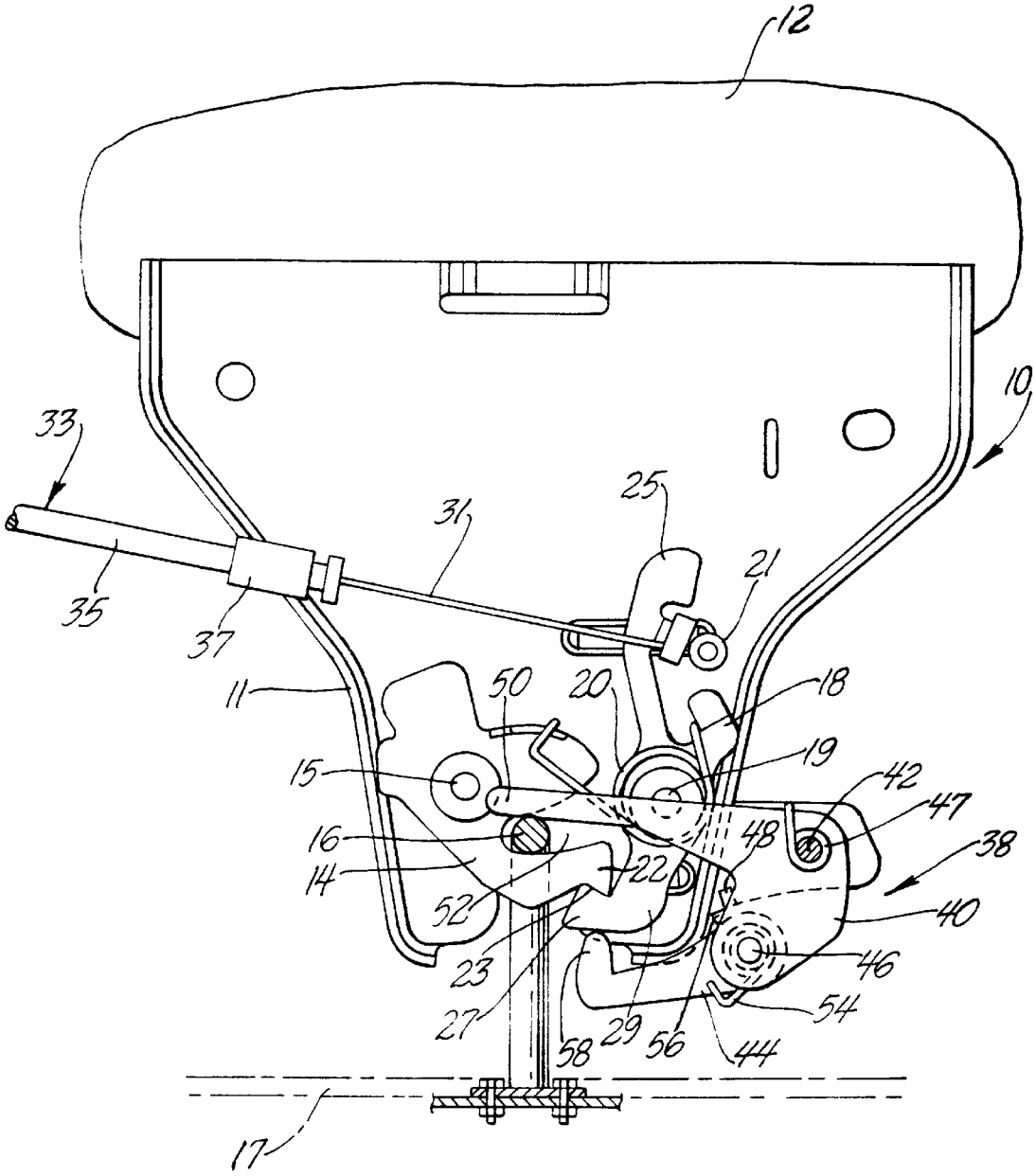
FIG. 2 is a rear view of the vehicle compartment latch of FIG. 1 showing the parts of the vehicle compartment latch when the fork bolt is in the closed or latched position.

Vehicle compartment latch 10 further comprises a detent lever 18 that pivots on support 11 about pivot pin 19 and cooperates with fork bolt 14 in a well known manner to retain fork bolt 14 in the closed position shown in FIG. 2 or release the fork bolt 14 for return to the open position shown in FIG. 1. That is, detent lever 18 pivots between a detent position shown in FIGS. 1 and 2 and a release position shown in FIG. 3. Fork bolt 14 is spring biased clockwise to the open position shown in FIG. 1 by a torsion spring 20 that surrounds pivot pin 19 with an extension at one end engaging fork bolt 14. An extension at the other end of torsion spring 20 engages detent lever 18 so that detent lever 18 is also spring biased clockwise by torsion spring 20 against abutment 21 of support 11 to the detent position shown in FIGS. 1 and 2. Detent lever 18 rides over end 22 of fork bolt 14 and engages latch shoulder 23 of fork bolt 14 when fork bolt 14 is moved from the unlatched position of FIG. 1 to the latched position of FIG. 2 by closing deck lid 12.

Detent lever 18 has an upper arm 25 and a catch 27 attached to a lower arm 29. Upper arm 25 is attached to the core 31 of a push pull cable 33 that has an end of its sheath 35 attached to support 11 by a fastener 37. Cable 33 is part of a remote control (not shown) that is used to move detent lever 18 from the latched position shown in FIGS. 1 and 2 to the release position shown in FIG. 3 allowing the deck lid 12 to be opened.

Vehicle compartment latch 10 is equipped with a detent block-out 38 that comprises a bell crank lever 40, that is pivotally mounted on support 11 by a pivot pin 42 and a detent pawl 44 that is pivotally mounted on bell crank lever 40 by a pivot pin 46.

Figure 3:
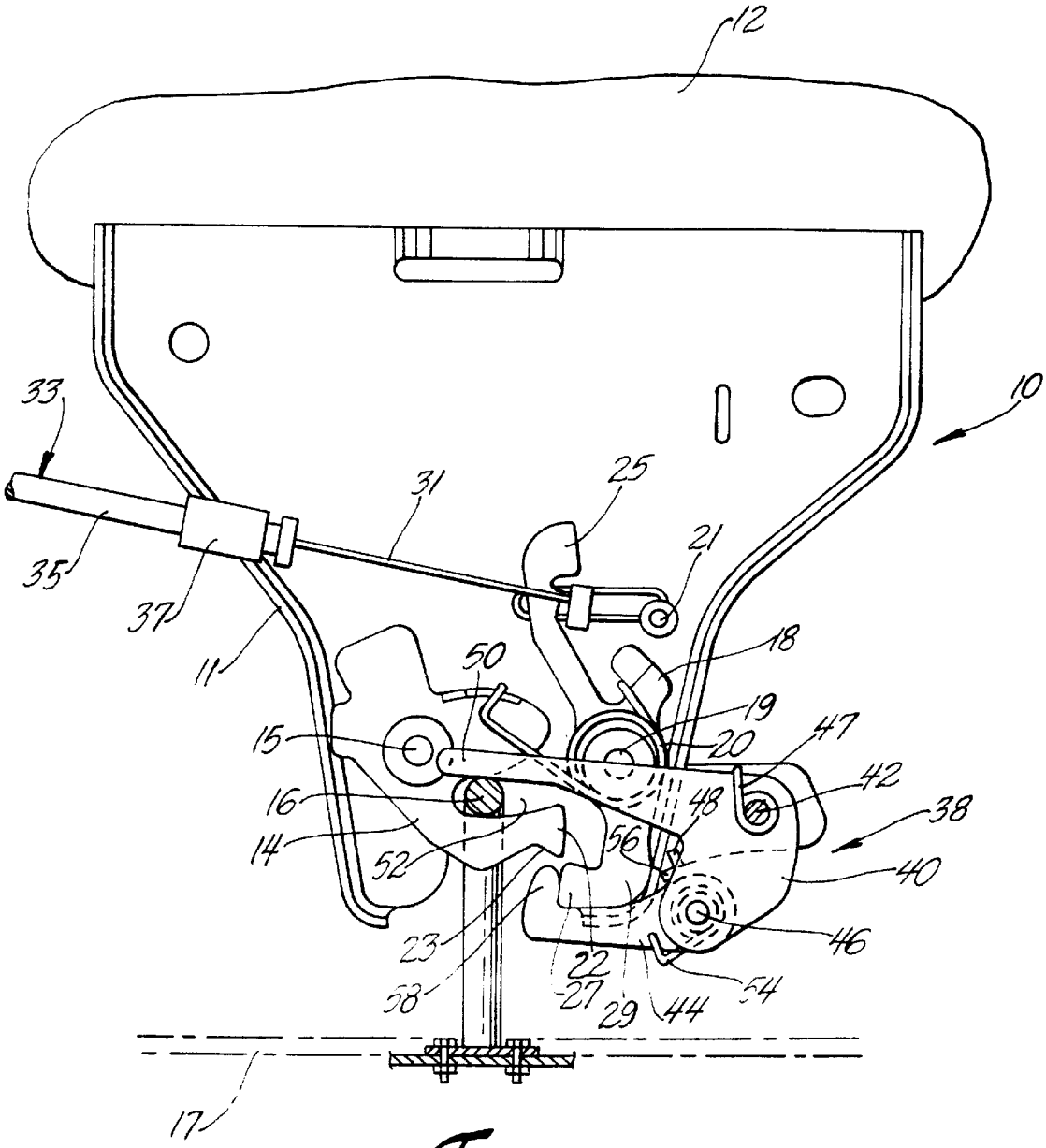
FIG. 3 is a rear view of the vehicle compartment latch shown in FIG. 1 showing the parts of the vehicle compartment latch when the detent is moved to the release position and the fork bolt held in the latched position by the striker.

Bell crank lever 40 serves as a striker position lever, being pivotal between a disengaged position shown in FIG. 1 and an engaged position shown in FIGS. 2 and 3. Bell crank lever 40 is biased to the disengaged position of FIG. 1, that is counterclockwise as viewed in FIG. 1, by a return spring 47 that biases bell crank lever 40 against a stop 48 of support 11. Bell crank lever 40 has an elongated arm 50 that overlaps a striker receiving slot 52 of fork bolt 14 so that arm 50 is in position to engage striker 16 when bell crank lever 40 is in the disengaged position of FIG. 1 and deck lid 12 is closed.

Detent pawl 44 pivots on bell crank arm 40 between a disengaged position shown in FIG. 1, a cocked position shown in FIG. 2 and an engaged position shown in FIG. 3. Detent 44 is biased to the disengaged position of FIG. 1, that is clockwise as view in FIG. 1, by a return spring 54 that biases detent pawl 44 clockwise with respect to bell crank lever 40 against a stop tab 56 of bell crank lever 40.

Vehicle compartment latch 10 operates in the following manner. When deck lid 12 is closed, fork bolt 14 engages striker 16 and fork bolt 14 is pivoted counterclockwise by the closing deck lid 12 from the open or unlatched position shown in FIG. 1 to the closed or latched position shown in FIG. 2 trapping striker 16 in slot 52 of fork bolt 14 as shown in FIG. 2. As fork bolt 14 pivots to the closed position, end 22 of fork bolt 14 engages and cams catch 27 of detent lever 18 into engagement with latch shoulder 23. As striker 16 engages and proceeds into slot 52 of fork bolt 14 to pivot fork bolt 14 counter-clockwise, striker 16 simultaneously engages arm 50 of bell crank lever 40 pivoting bell crank lever 40 clockwise from the disengaged position of FIG. 1 to the engaged position of FIG. 2. This causes detent pawl 44 to engage detent 18 and pivot counterclockwise on bell crank lever 40 a small amount against the action of return spring 54 from the disengaged position of FIG. 1 to the cocked position of FIG. 2 where detent pawl 44 rests against the lower arm 29 of detent lever 18. Thus whenever the deck lid 12 is closed, the deck lid 12 is latched securely in the closed position by compartment latch 10 with detent block-out 38 poised for action upon a subsequent opening of the deck lid.

Deck lid 12 is opened via push-pull cable 33 which pivots detent 18 counterclockwise from the engaged position of FIG. 2 to the release position shown in FIG. 3. As detent 18 is pivoted to the release position, it cams a hook 58 of detent pawl 44 into engagement with an end of catch 27 against the bias of return spring 54 to hold detent lever 18 in the release position shown in FIG. 3. With bell crank lever 40 and detent pawl 44 now both in their respective engaged positions shown in FIG. 3, deck lid 12 can now be opened at any time even if striker 16 remains in slot 52 of fork bolt 14 because there is no possibility of detent lever 18 returning to the latched position of FIGS. 1 and 2 until striker 16 exits slot 52.

When deck lid 12 is opened, striker 16, of course, exits slot 52 which allows fork bolt 14 to pivot clockwise and return to the disengaged position of FIG. 1 under the action of spring 20. As striker 14 moves out of slot 52, bell crank lever 40 is pivoted counter-clockwise and returns to the disengaged position of FIG. 1. As bell crank lever 40 pivots counter-clockwise, stop tab 56 engages detent pawl 44 and pivots detent pawl 44 counterclockwise releasing detent lever 18. Detent lever 18 then returns to the latched position shown in FIG. 1 under the action of torsion spring 20. Latch 10 is now ready for another latching operation when deck lid 12 is closed.

While the compartment latch of our invention has been described in connection with deck lid 12, the compartment latch of the invention can be used with other compartment closures where it is desirable to insure that the fork bolt, once released by the detent lever, remains released until the compartment door is opened without any need for high closing forces or kick-off springs. In other words, many modifications and variations of the present invention in light of the above teachings may be made. It is, therefore, to be understood that, within the scope of the appended claims, the invention may be practiced otherwise than as specifically described.

We claim:

1. A vehicle compartment latch comprising:

a support that is adapted for fastening to a closure, a fork bolt that is attached to the support for movement between an unlatched position and a latched position where the fork bolt has a striker receiving slot positioned to receive a striker, a detent lever that is attached to the support for movement between a detent position and a release position, the detent lever retaining the fork bolt in the latched position when in the detent position and releasing the fork bolt for return to the unlatched position when in the release position, means to move the detent lever from the detent position to the release position, a detent block-out that is attached to the support for movement between a disengaged position and an engaged position, the block-out maintaining the detent lever in the release position whenever the detent block-out is in the engaged position, the detent block out comprising a striker position lever that is attached to the support and a detent pawl that is attached to the striker position lever for movement between a cocked position and the engaged position where the detent pawl holds the detent lever in the release position, and the striker position lever having a portion that overlaps the striker receiving slot in the fork bolt so that striker position lever moves the detent pawl to the cocked position when the fork bolt is moved to the latched position whereby the detent pawl is poised to move to the engaged position to hold the detent lever in the release position when the detent lever is moved to the release position.

2. The vehicle compartment latch as defined in claim 1 wherein the striker position lever is a bell crank lever that has an elongated arm that provides the portion that overlaps the slot in the fork bolt and a second arm, the detent pawl being pivotally attached to the second arm so that the detent pawl pivots with respect to the bell crank lever.

3. The vehicle compartment latch as defined in claim 2 wherein the striker position lever is spring biased toward the disengaged position and the detent pawl is spring biased toward the disengaged position and toward the cocked position with respect to the striker position lever.

4. The vehicle compartment latch as defined in claim 1 wherein the striker position lever is spring biased toward the disengaged position and the detent pawl is spring biased toward the disengaged position and toward the cocked position with respect to the striker position lever.

5. A vehicle compartment latch comprising:

a support that is adapted for fastening to a closure, a fork bolt that is pivotally attached to the support for movement between an unlatched position and a latched position, the fork bolt being spring biased toward the disengaged position, the fork bolt having a latch shoulder and being adapted to receive a striker and retain the striker in the latched position, a detent lever that is pivotally attached to the support for movement between a detent position and a release position, the detent lever being spring biased toward the detent position and having a catch that engages the latch shoulder of the fork bolt to retain the fork bolt in the latched position when in the detent position, the detent lever releasing the fork bolt for return to the unlatched position when in the release position, means to move the detent lever from the detent position to the release position, and a detent block-out for maintaining the detent lever in the release position that includes a bell crank lever and a detent pawl, the bell crank lever being pivotally attached to the support for movement between a disengaged position and an engaged position, and spring biased toward the disengaged position, the bell crank lever having an elongated arm that overlaps the fork bolt for pivoting the bell crank lever to the engaged position responsive to a striker being retained by the fork bolt, and a second arm, the detent pawl being pivotally attached to the second arm of the bell crank lever for movement with respect to the bell crank lever and between a disengaged position, an intermediate cocked position and an engaged position, the detent pawl being spring biased toward the disengaged position and toward the intermediate cocked position with respect to the bell crank lever, the detent pawl holding the detent lever in the release position when the bell crank lever is in its engaged position.

6. The vehicle compartment latch as defined in claim 5 wherein the detent pawl has a hook that engages an end of the catch of the detent lever to hold the detent lever in the release position.

7. The vehicle compartment latch as defined in claim 6 wherein the detent lever is released by the detent pawl when the fork bolt returns to the unlatched position.

* * * * *